US009480356B2

(12) United States Patent
Afolabi

(10) Patent No.: US 9,480,356 B2
(45) Date of Patent: Nov. 1, 2016

(54) FOOTWEAR STORAGE DEVICE

(71) Applicant: Oluwafemi Ajibola Afolabi, Mississauga (CA)

(72) Inventor: Oluwafemi Ajibola Afolabi, Mississauga (CA)

( * ) Notice: Subject to any disclaimer, the term of this patent is extended or adjusted under 35 U.S.C. 154(b) by 0 days.

(21) Appl. No.: 14/817,474

(22) Filed: Aug. 4, 2015

(65) Prior Publication Data

US 2016/0066731 A1 Mar. 10, 2016

(51) Int. Cl.
*A47F 7/08* (2006.01)
*A47G 25/84* (2006.01)

(52) U.S. Cl.
CPC ..... *A47G 25/84* (2013.01); *A47F 7/08* (2013.01)

(58) Field of Classification Search
CPC ..... A47G 25/84; A47F 7/08
USPC ..... 211/34, 36, 37; 312/235.1, 235.2, 107; 297/423.41
See application file for complete search history.

(56) References Cited

U.S. PATENT DOCUMENTS 815,932 A * 3/1906 Porter ..... A47F 7/08 211/36
870,993 A * 11/1907 Richardson ..... A47F 7/08 211/184
996,636 A * 7/1911 Gabriel ..... B62B 3/02 211/189
1,018,286 A * 2/1912 Williams ..... A47F 7/08 211/149
1,079,606 A * 11/1913 Rooney ..... A47L 23/16 15/265
1,170,396 A * 2/1916 Bech ..... F16M 11/20 248/166
1,221,948 A * 4/1917 Young ..... A47B 87/02 312/107
1,265,609 A * 5/1918 Carry ..... A47L 23/16 15/265
1,270,817 A * 7/1918 Hammond ..... A47F 7/08 211/34
1,288,604 A * 12/1918 Jenkins ..... A47B 83/02 182/91
1,374,592 A * 4/1921 Locke ..... A43D 117/00 211/34
1,731,738 A * 10/1929 Dressel ..... A43D 117/00 12/1 A
1,893,801 A * 1/1933 Huffman ..... A47B 47/06 206/425
1,928,239 A * 9/1933 Amyot ..... F25D 3/04 312/107
2,017,433 A * 10/1935 Carrington ..... A47C 16/025 248/146
2,051,679 A * 8/1936 Chapman ..... A47F 7/08 211/134
2,267,158 A * 12/1941 Locke ..... A47L 23/205 297/188.08

(Continued)

*Primary Examiner* — Joshua J Michener
*Assistant Examiner* — Devin Barnett

(57) ABSTRACT

An enhanced boot tray that combines the functions of a boot tray, shoe scraper, foot rest or stool. This boot tray has a plurality of upward extending projections connected to a flat base. The base is surrounded by a wall that may rise up to the height of the projections to serve as an additional scraping surface for footwear. This boot tray may optionally be used with a foot rest designed with a top surface that has the same characteristics as the tray, and walls elevating the top surface. When used with the foot rest, the boot tray is placed underneath to save space while providing additional space to store footwear. The foot rest also serves as a boot tray and shoe scraper.

13 Claims, 5 Drawing Sheets

(56) References Cited

U.S. PATENT DOCUMENTS

D138,503 S * 8/1944 Churchill ..... 211/34
2,367,218 A * 1/1945 Joyce, Jr. ..... A43D 117/00 211/181.1
2,367,437 A * 1/1945 Salt ..... A47L 9/0018 15/323
D151,662 S * 11/1948 Smead ..... 312/235.1
2,611,416 A * 9/1952 Moore ..... A47K 13/00 108/131
3,271,075 A * 9/1966 Good ..... A47C 16/02 108/129
3,330,229 A * 7/1967 Ferdinand ..... A47B 57/20 108/107
3,762,573 A * 10/1973 Collins ..... A47L 23/20 211/34
3,974,917 A * 8/1976 Waxmanski ..... A47F 7/08 211/188
4,232,916 A * 11/1980 Correia ..... A47B 47/042 108/53.3
4,418,967 A * 12/1983 Winkelman, Jr. ... A47B 17/006 312/107
4,699,267 A * 10/1987 Burke ..... A45C 3/12 190/13 F
5,984,113 A * 11/1999 Roberson ..... A47F 7/08 211/1.57
6,010,187 A * 1/2000 Dallas ..... A47C 7/62 108/94
7,669,721 B2 * 3/2010 Kemper ..... A47L 19/04 211/126.1
8,567,615 B1 * 10/2013 Rainey ..... A47B 61/04 108/193
8,657,391 B2 * 2/2014 Simondi ..... A47F 7/08 211/34
D723,759 S * 3/2015 Evans ..... D32/55
2002/0056714 A1 * 5/2002 Schinkel ..... B05C 17/0245 220/570
2004/0178155 A1 * 9/2004 Brownfield ..... A47F 7/08 211/36
2005/0194338 A1 * 9/2005 Firth ..... D06F 57/06 211/194
2005/0252869 A1 * 11/2005 Graham ..... A47B 61/04 211/36
2006/0152114 A1 * 7/2006 Yamada ..... A47B 87/0215 312/107
2006/0213843 A1 * 9/2006 Botner ..... A47B 43/00 211/34
2006/0255644 A1 * 11/2006 Selby ..... A01B 75/00 297/423.41
2008/0073300 A1 3/2008 Abraitis
2009/0166303 A1 * 7/2009 Chiang ..... A47B 57/06 211/37
2009/0211993 A1 * 8/2009 Chiang ..... A47F 7/08 211/37
2010/0059460 A1 * 3/2010 Mulaw ..... A47L 19/04 211/41.3
2011/0183102 A1 7/2011 Afolabi
2012/0126595 A1 * 5/2012 Petrucci ..... A47C 16/025 297/217.6
2015/0136715 A1 * 5/2015 Tremblay ..... A47B 61/04 211/36
2015/0245710 A1 * 9/2015 Villalobos ..... A47F 5/025 211/1.55
2015/0351534 A1 * 12/2015 Rege ..... A47B 61/04 211/36

* cited by examiner

FOOTWEAR STORAGE DEVICE

FIELD OF THE INVENTION

The present invention relates generally to footwear storage devices used to store footwear that may contain particles such as debris and snow, or moisture. This invention also relates to boot scrapers used to remove particles from footwear. A third aspect of this invention relates to foot rests serving as elevated supports for footwear or people's feet.

BACKGROUND OF THE INVENTION

Boot trays are widely employed at entrances of buildings to store footwear, and prevent particles or moisture from being transported and deposited on delicate flooring like rugs, carpets, and hardwood. Boot trays have a flat base with elevated borders (walls) that contain the liquid deposits from shoes. They often feature slightly elevated projections within the borders that extend from the base to support footwear, or scrape off particles. These projections create space beneath footwear to drain off moisture and facilitate drying. Some boot trays have a foam or textile material placed on the flat base to absorb moisture from footwear. The distinguishing feature between a boot tray and a shoe rack is the ability of the tray to contain fluids and debris.

Boot or shoe scrapers are widely used to remove large or significant levels of particles from footwear prior to accessing a building. Scrapers may feature elevated straight edges, regularly-shaped or rough patterns to facilitate the removal of these solid particles. Boot trays that feature scrapers have their functionality limited by the height of the borders. Since the border's height exceeds that of the scrapers, the borders become an obstacle to someone stepping on the tray.

In conditions when significant levels of particles are transported by footwear such as heavy snowfall, households will often employ dedicated boot scrapers, doormats, and boot trays. In addition to the increased cost of purchasing these multiple devices, households may also be faced with congestion at the entryways. Some households further employ stools to assist in wearing, removing, or lacing footwear at the entrance. Stools placed by entrances allow individuals to handle their footwear comfortably and help avoid straining their backs. The problems of congestion and costs associated with using multiple devices at entrances will affect households using stools more significantly.

SUMMARY OF THE INVENTION

The following presents a simplified summary of the disclosure in order to provide a basic understanding to the reader. This summary is not an extensive overview of the disclosure and it does not necessarily identify key/critical elements of the invention or delineate the scope of the invention. Its sole purpose is to present some concepts disclosed herein in a simplified form as a prelude to the more detailed description that is presented later.

The invention provides a footwear storage device having a lower footwear tray for supporting footwear and a foot rest. The lower footwear tray is made of non-porous material and has a base with a substantially flat lower surface. The lower footwear tray also has multiple projections extending from the base. The heights of the projections are substantially the same. The foot rest includes an upper footwear tray for supporting footwear, and a frame for resting on a floor. The frame employs multiple supports configured to support the upper footwear tray so that when the frame is placed on a floor the upper footwear tray is substantially parallel to the floor at a fixed stool height above the floor. Where they contact the floor, the foot rest supports define a portion of the floor sized to receive the lower footwear tray so that when the lower footwear tray is placed over the defined portion of the floor, the lower footwear tray is directly underneath the upper footwear tray.

The upper footwear tray may be integrally formed with the frame, but it is preferred that the upper footwear tray is removable from the frame so that the upper footwear tray is no longer in contact with the frame, and is reattachable to the frame so that the upper footwear tray is again supported by the frame.

The frame and the upper footwear tray are preferably sufficiently rigid so that the upper footwear tray can support at least two pairs of footwear when the upper footwear tray is supported by the frame.

It is preferred that the lower footwear tray and upper footwear tray are identical, and also that the upper footwear tray is detachable from the frame.

The lower footwear tray may be substantially rectangular, having two shorter and two longer sides.

The lower footwear tray preferably has a base with a substantially flat lower surface, and a plurality of projections extending from the base, such that each projection has substantially the same height relative to the lower surface of the base. The lower footwear tray may also have a liquid retaining wall extending around the base at a height above the lower surface that is not greater than the height of the projections. The projections may be integrally formed with the base. The height of the liquid retaining wall may be substantially the same as the height of the projections. The liquid retaining wall may extend substantially around the base and have a liquid exit which is a portion of the wall with a lower height than the other portions of the wall. The liquid exit may be configured to facilitate removal of liquid from the lower footwear tray by tiling the lower footwear tray. The liquid retaining wall may have an upper portion configured to act as a scraper for scraping loose material off soles of footwear.

The frame supports may include two side walls, where the width of each side wall is substantially equal to the width of the lower footwear tray. Each side wall may have top ends at substantially the same height above the floor when the frame is placed on a floor. Then the walls are parallel to each other and separated by about the width of the lower footwear tray so that each shorter side of the lower footwear tray is proximate to a lower portion of one of the side walls. Where they contact the floor, the side walls may spaced apart by a distance greater than the width of the lower footwear tray by at least 10 mm.

The frame may also include a rear wall extending between rear ends of the two side walls.

The frame may further include one or more additional supports that are substantially parallel to the bottom surface of the base, where each support has a length approximately equal to the length of the lower footwear tray.

The stool height may be between 150 and 600 cm and is preferably between 200 and 400 cm.

The lower footwear tray and the foot rest may be made from thermoplastic material.

The frame may have no front wall so that the frame defines a front opening of the floor rest through which the lower footwear tray may be inserted so that the lower footwear tray is directly underneath the upper footwear tray, and through which the lower footwear tray may be removed from the foot rest.

DETAILED DESCRIPTION OF THE INVENTION

The invention is a device that combines the functions of a footwear (or boot or shoe) tray, a footwear (or boot or shoe) scraper, and a stool. After sufficient use, a tray with a flat base and an elevated border (or wall) contains fluids and debris. The tray projections inside the elevated borders are configured to support footwear. These projections extend above or to the same level as the elevated border wall to ensure unobstructed access by a person placing a foot on them. Also, the border is more efficiently used for scraping when its height does not exceed the height of the projections. These regularly-spaced projections are adapted to enable particle removal from footwear. The invention further describes a foot rest suspended above the first tray by side walls connecting its edges to the floor. In addition to serving as a supplementary boot tray and scraper, the foot rest acts as a stool that permits individuals to lace footwear without having to fully bend over and increase the risk of straining their back.

The boot tray may be positioned adjacent or below the foot rest to create additional storage space for footwear. When positioned below the foot rest, it creates additional storage space without occupying more floor space.

Figure 1:
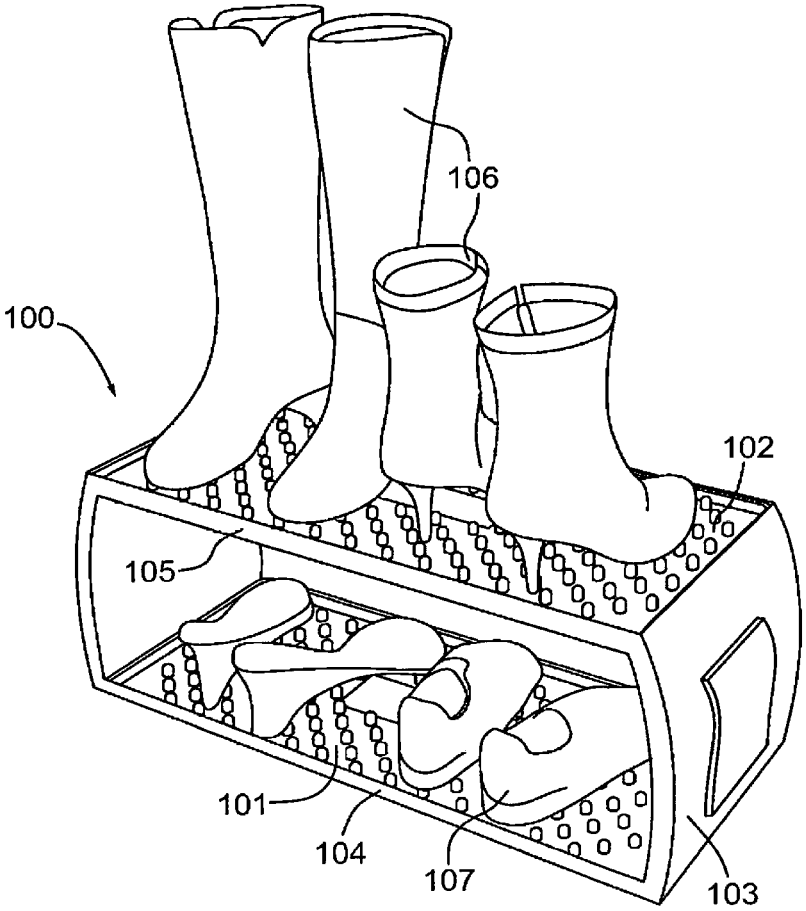
FIG. 1 is a perspective view of a preferred embodiment of the footwear storage device with footwear stored on top of the lower footwear tray and the upper footwear tray.

FIG. 1 shows a preferred embodiment of the footwear storage device 100 with footwear 106 stored on the upper footwear tray 102, which is attached to the frame (including the side walls 103), that acts as a shelf or stool. Other footwear 107 is also shown stored on the lower footwear tray 101 underneath the upper footwear tray 102. The footwear storage device 100 is preferably made from a non-porous material which may be thermoplastic material such as thermoplastic polyurethanes of the polyether or polyester type or aliphatic polyurethane, although any suitable materials known to skilled persons may be employed. For example, the lower footwear tray 101 may be made of a woven or non-woven fabric formed of synthetic or natural materials, such as a thermoplastic.

The footwear storage device 100 is preferably assembled from three separate parts that a user can dissemble and reassemble. The first part is a lower footwear tray 101, which can be seen in isolation in FIG. 3. The lower footwear tray 101 has a base with a substantially flat lower surface or bottom (not shown) for resting on a floor. The base has a relatively flat upper surface from which extends a plurality of projections 300, which may be integrally formed with the base. The projections 300 are configured so that they all have substantially the same height relative to the lower surface of the base, and therefore have substantially the same height relative to a floor on which the tray 101 is placed. The upper portions, or tops, of the projections are thereby all substantially in a single plane that is parallel to the bottom surface of the tray 101, and to the floor when the tray 101 is in use on a floor. It is not essential that the base have a relatively flat upper surface—it may alternately be inclined, curved or have multiple depressions and or patterns within its surface.

It should be understood that a "substantially flat lower surface or bottom" of either the lower or upper footwear tray does not necessarily mean that the bottom of the tray is all in the same plane. Rather it means that a sufficient number of points on the bottom of the tray are in a notional plane that is parallel and proximate to the floor when the tray is placed on a floor to support the tray and support footwear or people standing on the tray. Such a notional plane may be defined, for example, by the bottom ends of a sufficient number of projections or ribs rather than by a complete surface within the plane.

The projections 300 preferably extend substantially perpendicularly from the upper surface of the base. The height of the projections 300 above the upper surface of the base is chosen to that it is sufficient to allow a typical layer of snow or other material adhered to the sole of several shoes or boots to fall between the projections 300. A typical height for the projections 300 is about 1.2.5 mm (or 0.5 inches). A typical thickness of the base is about 2.3 mm. These can of course vary significantly in different embodiments. The density and thickness of the projections are selected so that the projections can support footwear with a relatively flat sole on the plane passing through the tops of the projections. More preferably, they are selected to support a person wearing shoes standing on the mat. For example, at least four projections may fall at least partially within any notional circle inscribed on the base having a diameter of 75 mm. The projections may be cylindrical and each have approximately the same width, which is preferably at least 3 mm and preferably not more than 25 mm. Each projection may preferably be separated from the nearest other projection by a distance of at least twice the diameter of the projections and preferably not by more than eight times the diameter of the projections, where the distance between projections is the distance between the central vertical axes of the projections. The projections are preferably cylindrical, but other shapes are possible, such as projections with a polygonal cross-section parallel to the base, and frustoconical projections.

The upper surface of the base is preferably flat and parallel to the lower surface of the tray 101 and the floor when it is resting on a floor, but this is not essential as it may slope or otherwise deviate from a plane parallel to the lower surface of the tray 101 by configuring the heights of the projections to vary accordingly so that their top ends lie in a common plane parallel to the bottom surface of the base.

The tray 101 preferably has a liquid retaining wall 400, 401 extending around part or all of the base at a height less than or substantially the same as the height of the projections 300, although in some embodiments the liquid retaining wall 400, 401 may be higher than the projections 300. The liquid retaining wall 400, 401 is preferably rigid and has a relatively sharp inner top edge, at least at the front, so that it may be used as a footwear scraper. A person with mud or snow on the sole of the person's shoe may thereby place the sole on top of the liquid retaining wall 400, 401 and then pull the shoe backwards so that the sole remains in contact with the top side of the liquid retaining wall 400, 401, and the inner surface of the liquid retaining wall 400, 401 scrapes the loose material off the sole of the shoe. This may be achieved by the choice of a sufficiently hard material to form the wall, configuring the wall to be sufficiently thick that it does not bend excessively and by configuring the liquid retaining wall 400, 401 so that the inner portion of the wall meets the top of the liquid retaining wall 400, 401 at a sharp angle, preferably of about 90 degrees, where the top of the wall is substantially parallel to the bottom surface of the base so that it can slide along the sole.

The lower footwear tray 101 is preferably substantially rectangular (where "substantially rectangular" includes embodiments having rounded corners) so that its length is significantly greater than its width, and it has two shorter sides (left and right) and two longer sides (rear and front) as shown in the figures.

The second part of the preferred footwear storage device 100 shown in the figures is an upper footwear tray 102, which is preferably identical to the lower footwear tray 101.

The third part of the preferred footwear storage device 100 shown in the figures is a frame that provides multiple supports to support the upper footwear tray. The frame and upper footwear tray together may be referred to as the foot rest. In the depicted embodiments, the supports include two side walls 103 that are substantially flat and parallel to each other. By "substantially flat", it is intended to include embodiments where the side walls 103 may have some relatively small amount of curvature as shown in the figures. The side walls 103 may also be somewhat angled while still being substantially parallel to each other. For example they may be angled inward from the bottom to the top by a few degrees so that the top ends of the side walls 103 are somewhat closer to each other than the bottom ends of the side walls 103.

Figure 2:
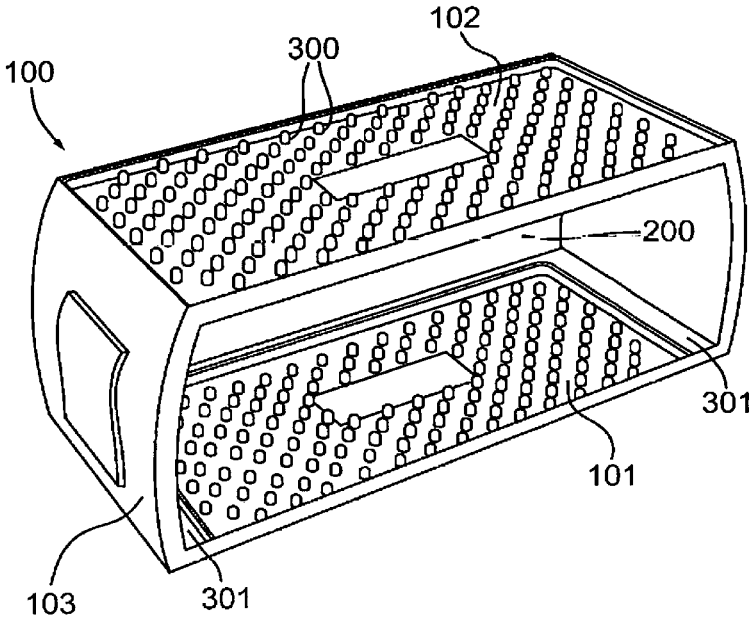
FIG. 2 is an upper perspective view of the footwear storage device of FIG. 1.
Figure 3:
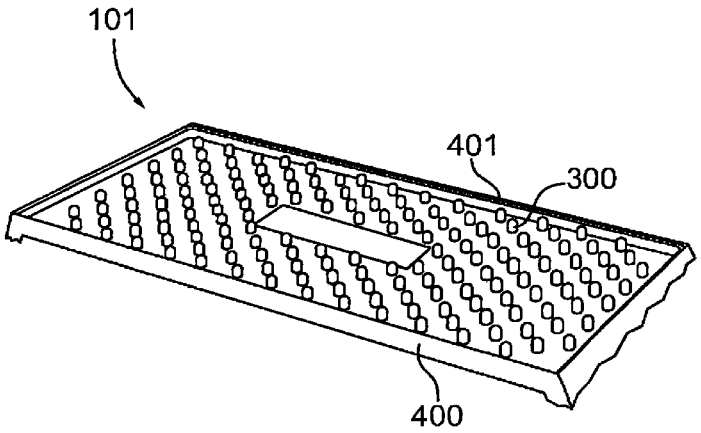
FIG. 3 is a perspective view of the lower footwear tray in isolation.
Figure 4:
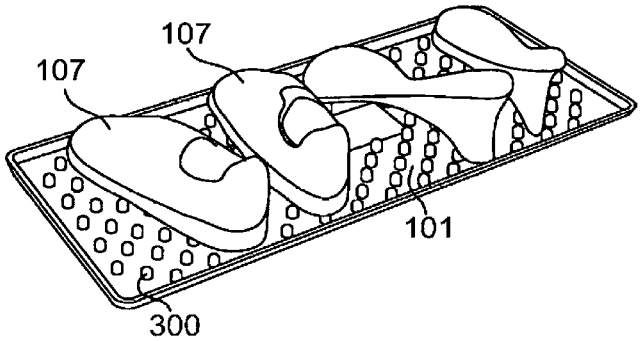
FIG. 4 is a perspective view of the lower footwear tray with footwear stored on the lower footwear tray.

The walls are spaced apart from each other at their bottom ends that contact the floor by approximately the length of the lower footwear tray 101, or a somewhat greater distance, so that the lower footwear tray 101 can be placed between the walls 103 as shown in FIGS. 1-3. The walls 103 are spaced apart from each other at their upper ends by the length of the upper footwear tray 102 so that the upper ends of the walls 103 can support the upper footwear tray 102. This may be done, for example, by having an inner lip extending perpendicular to the walls, and parallel to the lower surface of the base, below the tops of the walls.

In the depicted embodiment the side walls 103 are connected at the rear by a solid rear wall 200 which has the same height as the side walls 103 and is also configured to receive the upper footwear tray 102, for example, with a lip at the same height as the lips on the side walls 103. The side walls 103 are connected at the front by upper and lower support bars 104, 105, which extend parallel to the bottom surface of the base between the bottom portions and top portions respectively of the fronts of the side walls 103. The upper front support bar 105 may also have an inner lip at the same height as inner lips on the side walls 103 and rear wall 200 for supporting the upper footwear tray 102.

Additional support bars may also connect the side walls 103 between the bottom portions and top portions respectively of the rear side of the side walls 103. This is required particularly in embodiments that do not employ a solid rear wall 200. It is also preferable to employ a third support bar on the rear side, connecting the mid portions of the rear sides of the side walls 103 together for extra strength. One or more vertical support bars may also be employed to support the rear edge of the upper footwear tray 102.

As shown in the figures, the front side of the foot rest is left open to facilitate inserting the lower footwear tray 101 and removing the lower footwear tray 101 from the portion of the floor defined by the frame to receive the lower footwear tray 101. It is preferable to have the lower portions of the side walls 103 spaced apart by somewhat more than the length of the lower footwear tray 101. For example, it is preferred that they be separated at the inner part of the bottom ends that rest of the floor by the length of the lower footwear tray 101 plus at least two times the width of an average person's fingers (for example, 10 mm or 5-25 mm). This means that when the lower footwear tray 101 is inserted in the foot rest, then some space may be left at either side adjacent to the side walls 103 for a person to easily pick up the lower footwear tray 101 when it comes time to remove it for cleaning or storage. This also facilitates removing the lower footwear tray 101 without significantly bending it, so that all the liquid that has accumulated on the lower footwear tray 101 may be removed along with the lower footwear tray 101, and then be disposed of in a suitable location. Such a configuration is shown in FIG. 2, where spaces 301 can be seen between the shorter ends of the lower footwear tray 101 and the side walls 103.

Figure 6:
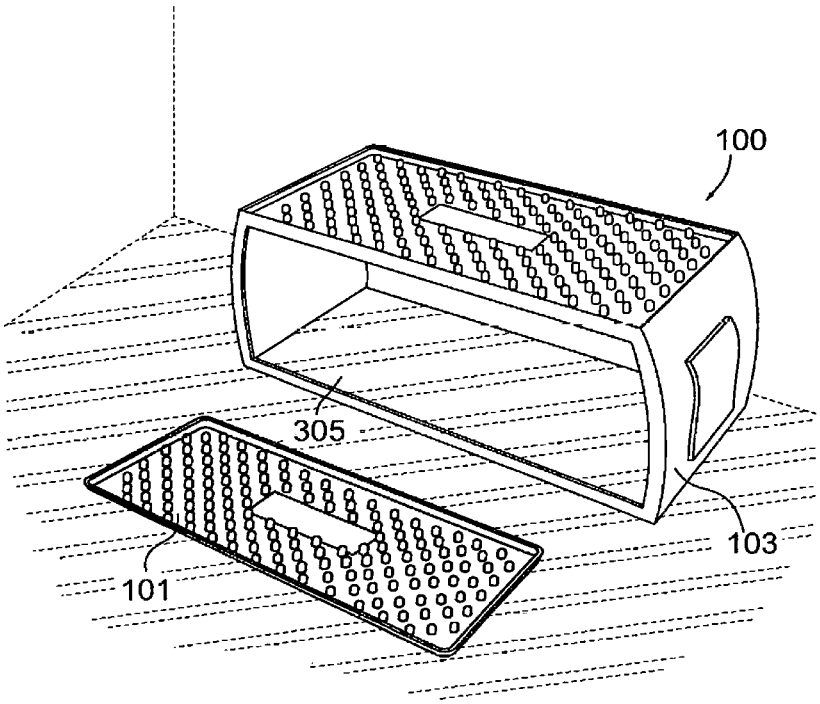
FIG. 6 is a perspective view of the footwear storage device where the lower footwear tray has been removed from the foot rest.

FIG. 6 shows the footwear storage device where the lower footwear tray 101 has been removed from the portions of the floor 305 defined by the two side walls 103 and the lower footwear tray 101 has been placed on the floor in front of the foot rest.

The foot rest may be configured so that the front support bar 104 and rear wall 200 (or a lower rear support bar) provide a friction fit with the lower footwear tray 101 (so that they are separated by approximately the width of the lower footwear tray 101). Alternatively, the front support bar 104 and rear wall 200 (or a lower rear support bar) may be separated by somewhat more than the width of the lower footwear tray 101, in which case, the foot rest may readily be lifted and moved without lifting the lower footwear tray 101.

The liquid retaining wall 400, 401 may incorporate a liquid exit (not shown), which is a portion of the liquid retaining wall 400, 401 with a lower height than the rest of the liquid retaining wall 400, 401 so that when a person is emptying the liquid accumulated on the base of the mat, the lower footwear tray 101 may be tilted so that the liquid exit is below the rest of the mat and the liquid is directed through that liquid exit.

The upper footwear tray may be integrally formed with the frame, but it is preferred that it be a separate piece that can be detached from the frame. In normal use, the upper footwear tray 102 is attached to the frame as shown in the figures, for example by resting on a lip that extends around the inner portion of the frame near the top of the frame parallel to the bottom surface of the base. The size of the frame is preferably configured to tightly fit with the upper footwear tray 102 so that the upper footwear tray 102 is held in place, attached to the frame, by a friction fit. The upper footwear tray 102 is then removable by a person pulling or pushing it upward to dislodge it from the frame. This may be desirable, for example, in case water has drained from the footwear stored on top of the upper footwear tray 102 so that the water can be discarded and the upper footwear tray 102 cleaned easily.

Such embodiments employing three separable parts also provide flexibility so that, for example, both mats can be separated from the frame and both placed on a floor beside each other if desired. The footwear storage device 100 is easily reassembled by placing the upper footwear tray 102 back so that it is again supported by the frame, and replacing the lower footwear tray 101 so that it is resting on the floor in the portion of the floor defined by the foot rest supports. In the embodiments depicted, such a region is defined by the inner lower ends of the side walls 103, the inner lower end of the rear wall 200, and the inner lower side of the lower front support 104. In other embodiments, the rear portion of the region may be defined by the inner lower side of a lower rear support (similar to the lower front support 104). It is not essential that lower front and rear supports be used, but it is preferred for strength. If they are not used, the region for placing the lower footwear tray 101 is just defined by the lower sides of the side walls 103 (which form the shorter sides of a notional rectangle on the floor that is the defined region). In any case, it is generally desirable to place the lower footwear tray 101 directly below the upper footwear tray 102 to minimize the footprint of the footwear storage device 100.

Figure 5:
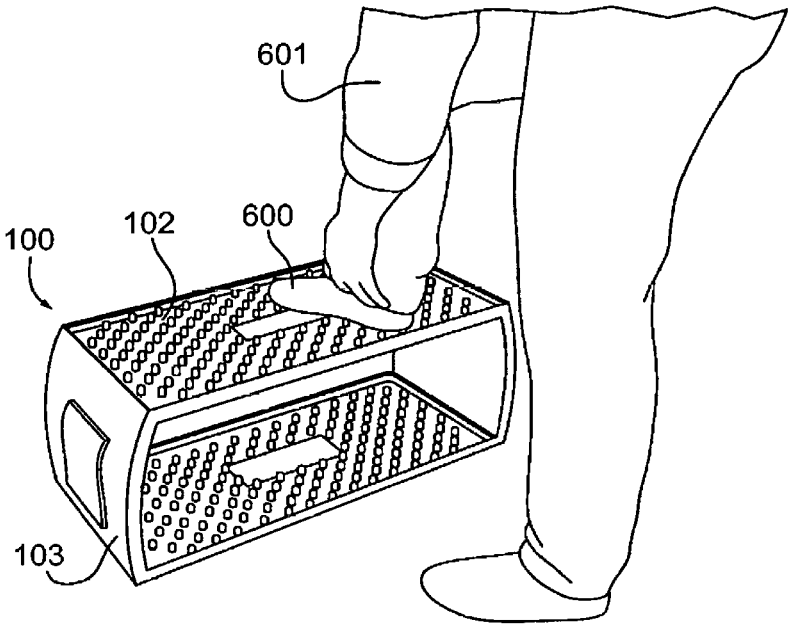
FIG. 5 is a perspective view of a person placing one foot on the shelf of the footwear storage device in order to tie the shoelace on the shoe worn on that foot.

It is preferred that the footwear storage device 100 be made from a sufficiently strong material of sufficient thickness, and employ sufficient support bars that when it is assembled and the upper footwear tray 102 is on the supports, then the upper footwear tray 102 can support several pairs of shoes and boots without significant bending, and can also provide support to a person 601 lacing their shoes, as shown in FIG. 5 where the person's foot wearing a show 600 is placed on top of the foot rest. In some embodiments, the materials and supports may be chosen and configured so that a normal weight person can sit on the upper footwear tray 102 like a stool, although this is not generally required.

The term floor as used herein includes any substantially flat surface on which one may want to place a footwear storage device, such as the surface of a porch outside the exterior door of a house.

The upper notional plane containing the tops of the projections 300 on the upper footwear tray 102 acts as a shelf, or the top of a stool, that a person can place the sole of the person's footwear on. This plane is at a fixed height above the bottom surface of the base of the frame, which height is referred to herein as the "stool height". The stool height is generally preferred to be in the range of about 150 to 600 mm, and more preferably between 200 and 400 mm. The stool height limits the height of footwear that can be stored on top of the lower footwear tray 101 while sitting the footwear upright with the soles of the footwear on the tops of the projections 300 on the lower footwear tray 101. It is generally preferred that there be enough room so that most shoes can be stored upright on top of the lower footwear tray 101 and below the upper footwear tray 102.

The abbreviation mm as used herein refers to millimeters (or in the US, "millimeters"). The abbreviation cm as used herein refers to centimeters (or in the US, "centimeters").

It should be understood that the above-described embodiments of the present invention, particularly, any "preferred" embodiments, are only examples of implementations, merely set forth for a clear understanding of the principles of the invention. Many variations and modifications may be made to the above-described embodiments) of the invention as will be evident to those skilled in the art.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are to used to specify the presence of stated features, elements, integers, steps or components, and do not preclude, nor imply the necessity for, the presence or addition of one or more other features, elements, integers, steps, components or groups thereof.

The scope of the claims that follow is not limited by the embodiments set forth in the description. The claims should be given the broadest purposive construction consistent with the description and figures as a whole.

What is claimed is:

1. A footwear storage device configured to be used as a foot stool comprising:

a lower footwear tray for storing footwear, the lower footwear tray being made of non-porous material and comprising a base including a substantially flat rectangular surface having a surface area, a perimeter surrounding the surface area, and a liquid retaining wall extending upwardly around the perimeter of the flat surface, wherein the liquid retaining wall defines borders which are configured to prevent liquids, moisture, or particles from the footwear from falling out of the lower footwear tray on to rugs, carpets, or floors;

the lower footwear tray further comprising a plurality of spaced projections extending upwardly from the flat surface of the base within the borders, the projections substantially covering the surface area of the flat surface, each projection having a height above the lower surface, wherein the heights of the projections are substantially the same as each other, the projections are configured to support the footwear and scrape off particles from the footwear, wherein the projections create space between the footwear and the flat surface of the base to drain off moisture and facilitate drying of the footwear; and a foot rest comprising an upper footwear tray for supporting footwear, the upper footwear tray being made of non-porous material and comprising a base including a substantially flat rectangular surface having a surface area and a perimeter surrounding the surface area, the upper footwear tray further comprising a plurality of spaced projections extending upwardly from the flat surface, the projections substantially covering the surface area of the flat surface, each projection having a height above the lower surface, wherein the heights of the projections are substantially the same and the projections are configured to support the footwear and scrape off particles from the footwear, wherein the projections create space between the footwear and the flat surface of the base to drain off moisture and facilitate drying of the footwear; and a frame configured to rest upon a floor, the frame comprising a plurality of generally planar side walls and a generally planar back wall each having an upper end and a lower end that rest directly on the floor, and being configured to support the upper footwear tray, wherein the upper ends of the side walls and the back wall form an upper retaining wall that surrounds and extends upwardly from the upper footwear tray; wherein the upper retaining wall defines borders which are configured to prevent liquids, moisture, or particles from the footwear from falling out of the lower footwear tray on to rugs, carpets, or floors, wherein each side wall has a width substantially equal to the width of the lower footwear tray;

wherein when the frame is placed on the floor the upper footwear tray is substantially parallel to the floor at a fixed stool height above the floor, and the lower ends of the side walls and the back wall define an open bottom, defining a portion of the floor sized to receive the lower footwear tray so that the lower footwear tray is placeable directly on the floor to rest on the floor in the portion of the floor defined by the lower ends of the side walls and the back wall of the frame, wherein the frame further comprises a front support bar extending between and connecting the side walls, the support bar having a length approximately equal to a length of the lower footwear tray;

wherein the sidewalls and the support bar of the frame defines a front opening of the foot rest through which the lower footwear tray is configured to be inserted so that the lower footwear tray is directly underneath the upper footwear tray, and through which the lower footwear tray can be removed from the foot rest;

wherein when the lower footwear tray is placed on the defined portion of the floor, the lower footwear tray is directly underneath the upper footwear tray, and wherein the lower footwear tray is removable from the portion of the floor defined by the lower ends of the frame.

2. The footwear storage device of claim 1, wherein the upper footwear tray is integrally formed with the frame.

3. The footwear storage device of claim 1, wherein the upper footwear tray is removable from the frame so that the upper footwear tray is no longer in contact with the frame, and is reattachable to the frame so that the upper footwear tray is again supported by the frame.

4. The footwear storage device of claim 1, wherein the frame and the upper footwear tray are sufficiently rigid so that the upper footwear tray can support at least two pairs of footwear when the upper footwear tray is supported by the frame.

5. The footwear storage device of claim 3, wherein the lower footwear tray and upper footwear tray are identical, and the upper footwear tray is detachable from the frame.

6. The footwear storage device of claim 1, wherein the projections are integrally formed with the base.

7. The footwear storage device of claim 1, wherein the height of the liquid retaining wall is substantially the same as the height of the projections.

8. The footwear storage device of claim 1, wherein the liquid retaining wall has an upper portion configured to act as a scraper for scraping loose material off soles of footwear.

9. The footwear storage device of claim 1, wherein the frame further comprises an additional support bar substantially parallel to the bottom surface of the base, having a length approximately equal to the length of the lower footwear tray.

10. The footwear storage device of claim 1, wherein, where they contact the floor, the side walls are spaced apart by a distance greater than the width of the lower footwear tray by at least 10 mm.

11. The footwear storage device of claim 1, wherein the stool height is between 150 and 600 mm.

12. The footwear storage device of claim 11, wherein the stool height is between 200 and 400 mm.

13. The footwear storage device of claim 1, wherein the lower footwear tray and the foot rest are made from thermoplastic material.

* * * * *